US009638455B2

(12) United States Patent
Kim et al.

(10) Patent No.: US 9,638,455 B2
(45) Date of Patent: May 2, 2017

(54) REFRIGERATOR AND METHOD FOR OPERATING THE SAME

(71) Applicant: LG ELECTRONICS INC., Seoul (KR)

(72) Inventors: Seojung Kim, Seoul (KR); Yonghwan Eom, Seoul (KR); Kyeongyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 511 days.

(21) Appl. No.: 14/101,836

(22) Filed: Dec. 10, 2013

(65) Prior Publication Data

US 2014/0157800 A1 Jun. 12, 2014

(30) Foreign Application Priority Data

Dec. 10, 2012 (KR) ..... 10-2012-0142857

(51) Int. Cl.
*F25D 21/06* (2006.01)
*F25D 21/00* (2006.01)
*F25D 21/08* (2006.01)

(52) U.S. Cl.
CPC ..... *F25D 21/002* (2013.01); *F25D 21/006* (2013.01); *F25D 21/08* (2013.01)

(58) Field of Classification Search
CPC ..... F25D 21/002; F25D 21/006; F25D 21/08
See application file for complete search history.

(56) References Cited

U.S. PATENT DOCUMENTS 4,332,138 A * 6/1982 Nakagawa ..... F25B 5/04 62/199
4,569,205 A * 2/1986 Dempou ..... F25D 11/022 62/155
4,808,009 A * 2/1989 Sittler ..... F25D 21/02 338/22 SD
6,314,745 B1 * 11/2001 Janke ..... F25C 5/005 62/137
2011/0185755 A1 8/2011 Kim et al.

FOREIGN PATENT DOCUMENTS

CN 101988839 A 3/2011
EP 2 426 443 A2 3/2012
GB 2 340 922 A 3/2000

* cited by examiner

*Primary Examiner* — Larry Furdge
(74) *Attorney, Agent, or Firm* — Birch, Stewart, Kolasch & Birch, LLP

(57) ABSTRACT

A refrigerator including an evaporator to carry out heat exchange, a frost sensing unit to sense an amount of frost formed on the frost sensing unit, and a heater to be operated for removing the frost from the frost sensing unit is provided. The heater is operated in at least a portion of a defrosting section. Methods for operating the refrigerator are also provided.

15 Claims, 12 Drawing Sheets

REFRIGERATOR AND METHOD FOR OPERATING THE SAME

CROSS-REFERENCE TO RELATED APPLICATIONS

This application claims priority to Korean Application No. 10-2012-0142857, filed on Dec. 10, 2012, which is herein incorporated by reference in its entirety.

BACKGROUND OF THE INVENTION

Field of the Invention

The present invention relates to a refrigerator and a method for operating the same. More specifically, the present invention relates to a refrigerator and a method for operating the same which can remove frost from a frost sensing unit, regularly.

Description of Related Art

In general, the refrigerator, a domestic appliance used for fresh storage of food for a long time period, is provided with a freezing chamber for frozen storage of the food, a refrigerating chamber for refrigerated storage of the food, and a refrigerating cycle for cooling down the freezing chamber and the refrigerating chamber, operation of which is controlled by a control unit built therein.

Different from old times, since a kitchen space transforms, not to a space for a dietary life merely, but to an important living space where family members gather, not only to converse, but also to solve the dietary life, it is the present situation that the refrigerator, a core element of the kitchen space, is required to be larger than ever, as well as to undergo quantitative/qualitative functional changes for all of the family members to use the refrigerator, conveniently.

BRIEF SUMMARY OF THE INVENTION

Accordingly, the present invention has been made in an effort to solve the aforementioned problems, and it is an object of the present invention to provide a refrigerator and a method for operating the same which can remove frost from a frost sensing unit, regularly.

To achieve the object of an embodiment of the present invention, a refrigerator includes an evaporator to carry out heat exchange, a frost sensing unit to sense an amount of frost formed on the frost sensing unit, and a heater to be operated for removing the frost from the frost sensing unit, wherein the heater is operated in at least a portion of a defrosting section.

To achieve the object of an embodiment of the present invention, a method for operating a refrigerator includes the steps of sensing an amount of frost formed on an evaporator, driving a heater when the amount of frost formed is larger than a predetermined value, and finishing operation of the heater if a heating time period is finished, wherein the heater is operated at least a portion of a defrosting section.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

In what follows, a refrigerator and a method for operating the same according to preferred embodiments of the present invention will be described in detail with reference to the appended drawings.

Since suffixes "module" and "unit" on element used in following description are given taking convenience of describing the specification into account merely, no special meaning or role is given thereto. Accordingly, the "module" and "unit" may be used, mixed with each other.

Figure 1:
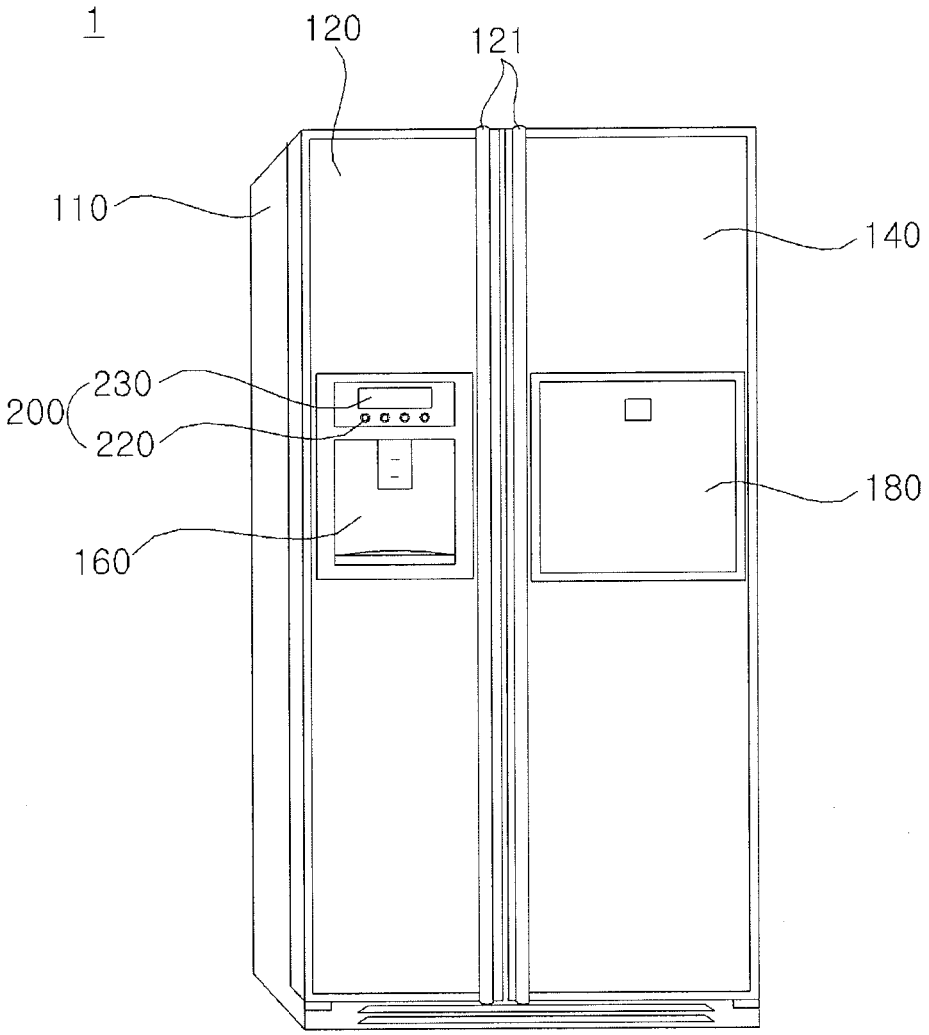
FIG. 1 is a perspective view illustrating a refrigerator in accordance with a preferred embodiment of the present invention.

FIG. 1 is a perspective view illustrating a refrigerator in accordance with a preferred embodiment of the present invention.

Referring to FIG. 1, the refrigerator 1 forms an outline of an exterior appearance thereof with a case 110 having, though not shown, an inside space partitioned into a freezing chamber and a refrigerating chamber, a freezing chamber door 120 for closing the freezing chamber and a refrigerating chamber door 140 for closing the refrigerating chamber.

And, each of the freezing chamber door 120 and the refrigerating chamber door 140 has a door handle 121 provided to, and projected from, a front thereof additionally for user's easy holding and rotation of the freezing chamber door 120 or the refrigerating chamber door 140.

In the meantime, additionally provided to the front of the refrigerating chamber door 140, there may be a home bar 180 which is convenience means for the user to take stored articles, such as drink, out of the refrigerating chamber without opening the refrigerating chamber door 140, easily.

And, provided to the front of the freezing chamber door 120, there may be a dispenser 160 which is convenience means for the user to take ice or drinking water out of the dispenser 160 easily without opening the freezing chamber door 120 additionally, and a control panel 200 over the dispenser 160 for controlling operation of the refrigerator 1 and displaying a state of the refrigerator 1 under operation on a screen, additionally.

The control panel 200 may include an input unit 220 having a plurality of buttons provided thereto, and a display unit 230 for displaying a control frame and an operation state.

The display unit 230 displays the control frame, and information on the operation state, and a temperature of an inside of the refrigerator. For an example, the display unit 230 may display a service mode of the dispenser (ice cubes, water, or ice pieces), a set temperature of the freezing chamber, and a set temperature of the refrigerating chamber.

The display unit 230 may be embodied of a variety of devices, such as LCD, LED, and OLED. And, the display unit 230 may also be embodied of a touch screen which can also carry out a function of the input unit 220.

The input unit 220 may have the plurality of operation buttons. For an example, the input unit 220 may include a dispenser setting button (not shown) for setting the service mode of the dispenser (ice cubes, water, or ice pieces), a freezing chamber temperature setting button (not shown), and a refrigerating chamber temperature setting button (not shown). In the meantime, the display unit 220 may be embodied of the touch screen which can also carry out a function of the display unit 230.

In the meantime, the refrigerator related to the present invention is not limited to a double door type shown in the drawing, but will be adequate as far as the refrigerator has a compressor and a fan for a refrigerating cycle or a freezing cycle of the refrigerator, regardless of types thereof, such as one door type, sliding door type, curtain door type, and so on.

Figure 2:
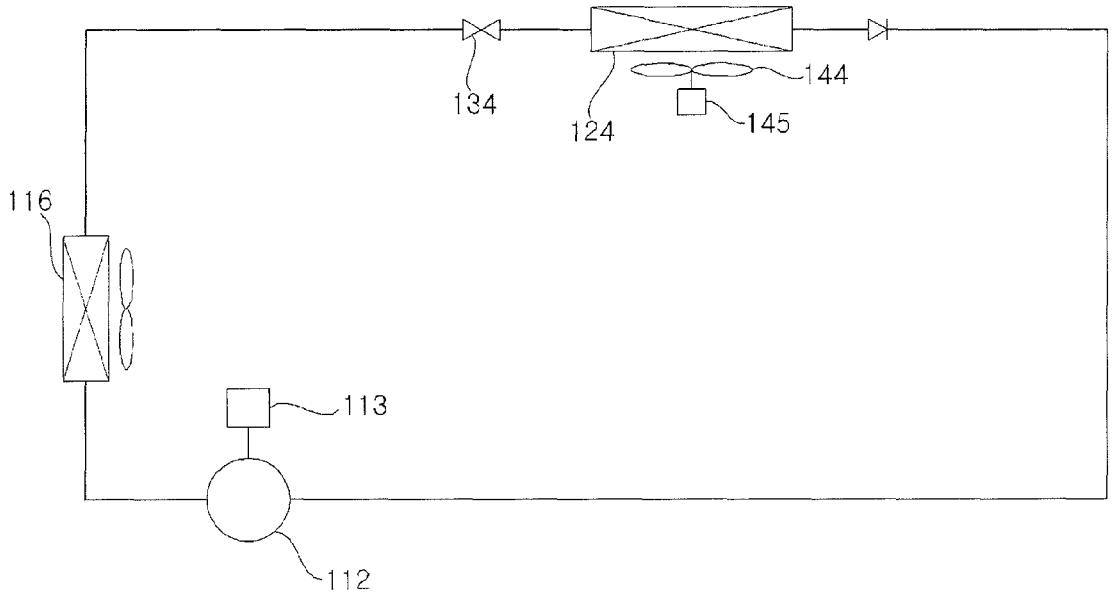
FIG. 2 is a block diagram illustrating a refrigerating cycle of the refrigerator in FIG. 1.

FIG. 2 is a block diagram illustrating a refrigerating cycle of the refrigerator in FIG. 1.

Referring to FIG. 2, the refrigerator 1 may include a compressor 112, a condenser 116 for condensing refrigerant compressed at the compressor 112, a freezing chamber evaporator 124 arranged for the freezing chamber (not shown) for evaporating the refrigerant condensed at, and received from, the condenser 116, and a freezing chamber expansion valve 134 for expansion of the refrigerant from the freezing chamber evaporator 124.

In the meantime, even though the drawing illustrates only one evaporator, each of the refrigerating chamber and the freezing chamber may have one evaporator provided thereto.

That is, the refrigerator 1 may further include a refrigerating chamber evaporator (Nor shown) arranged for the refrigerating chamber (not shown), a 3-way valve (not shown) for supplying the refrigerant from the condenser 116 to the refrigerating chamber evaporator (not shown) or the freezing chamber evaporator 124, and a refrigerating chamber expansion valve (not shown) for expansion of the refrigerant to be supplied to the refrigerating chamber (not shown).

And, the refrigerator 1 may further include a gas-liquid separator (not shown) for separating the refrigerant passed through the evaporator 124 into liquid refrigerant and a gas refrigerant.

And, the refrigerator 1 may further include a refrigerating chamber fan (not shown) and a freezing chamber fan 144 for drawing in cold air passed through the freezing chamber evaporator 124 and blowing the same to the refrigerating chamber (not shown) and the freezing chamber (not shown), respectively.

And, the refrigerator 1 may further include a compressor driving unit 113 for driving the compressor 112, and a refrigerating chamber fan driving unit (not shown) and a freezing chamber fan driving unit 145 for driving the refrigerating chamber fan (not shown) and the freezing chamber fan 144, respectively.

In the meantime, as shown, since a common evaporator 124 is used for the refrigerating chamber and the freezing chamber, a damper (not shown) may be mounted between the refrigerating chamber and the freezing chamber, and the fan (not shown) may forcibly blow the cold air produced at the one evaporator to the freezing chamber and the refrigerating chamber.

Figure 3:
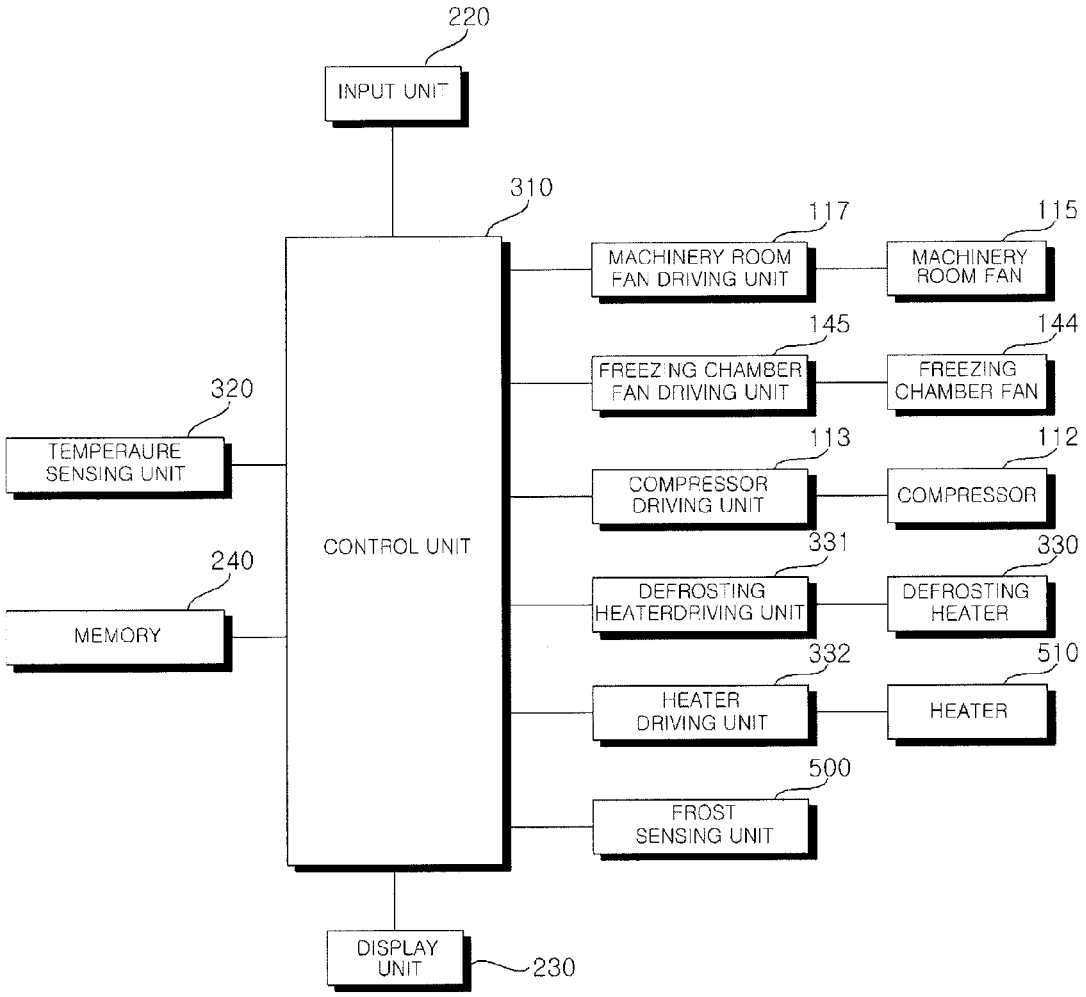
FIG. 3 is a block diagram illustrating a control system of the refrigerator in FIG. 1.

FIG. 3 is a block diagram illustrating a control system of the refrigerator in FIG. 1.

Referring to FIG. 3, the refrigerator includes a compressor 112, a machinery room fan 115, a freezing chamber fan 144, a control unit 310, a defrosting heater 330, a heater 510, a frost sensing unit 500, a temperature sensing unit 320, and a memory 240. And, the refrigerator may further include a compressor driving unit 113, a machinery room fan driving unit 117, a freezing chamber fan driving unit 145, a defrosting heater driving unit 331, a heater driving unit 332, a display unit 230, and an input unit 220.

Refer to description with reference to FIG. 2 on description of the compressor 112 and the freezing chamber fan 114.

The input unit 220 is provided with a plurality of operation buttons for forwarding a signal on the refrigerating chamber set temperature or the refrigerating chamber set temperature applied thereto to the control unit 310.

The temperature sensing unit 320 senses the temperature in the refrigerator and forwards a signal on the temperature sensed thus to the control unit 310. In this case, the temperature sensing unit 320 senses the refrigerating chamber temperature and the freezing chamber temperature. And, the temperature sensing unit 320 may also sense a temperature in each chamber in the refrigerating chamber and each chamber in the freezing chamber.

Referring to FIG. 3, in order to control turn on/off of the compressor 112 and the fan 115 or 144, the control unit 310 controls the compressor driving unit 113 and the fan driving unit 117 or 145 directly, to control the compressor 112 and the fan 115 or 144, finally. In this case, the fan driving unit may be the machinery room fan driving unit 117 or the freezing chamber fan driving unit 145.

For an example, the control unit 310 may have a microcomputer built therein for outputting a speed order signal for the compressor driving unit 113 or the fan driving unit 117 or 145.

The compressor driving unit 113, and the freezing chamber fan driving unit 145 may have a compressor motor (not shown) and a freezing chamber fan motor (not shown). The motors may be rotated at target rotation speeds under the control of the control unit 310, respectively.

In the meantime, the machinery room fan driving unit 117 may have a machinery room fan motor (not shown). The machinery room fan motor (not shown) may be rotated at a target rotation speed under the control of the control unit 310.

If each of the motors is a three phase motor, the motor may be controlled by switching inside of an inverter (not shown), or controlled to rotate at a constant speed by using an AC current as it is. In this case, each of the motors may be one of an induction motor, a BLDC (Brushless DC) motor, or a synRM (synchronous reluctance motor).

In the meantime, as described before, besides the operation control of the compressor 112 and the fan 115 or 144, the control unit 310 may control general operation of a refrigerator 1.

That is, the control unit 310 may control general operation of a refrigerant cycle according to the temperature set through the input unit 220. For an example, besides the compressor driving unit 113, the freezing chamber fan driving unit 145, and the machinery room fan driving unit 117, the control unit 310 may further control the freezing chamber expansion valve 134. And, the control unit 310 may also control operation of the condenser 116. And, the control unit 310 may also control the display unit 230.

The defrosting heater 330 is operated for removing frost formed in the vicinity of the evaporator 124. The defrosting heater 330 may be operated by controlling the defrosting heater driving unit 331.

Particularly, the defrosting heater 330 is operated depending on an amount of the frost in the vicinity of the evaporator 124 sensed at the frost sensing unit 500.

In the meantime, with regard to the embodiment of the present invention, the frost sensing unit 500 senses the amount of frost formed on the evaporator 124. And, the heater 510 is operated for removing the frost from the frost sensing unit 500.

The heater 510 is operated by the heater driving unit 332, and the control unit 310 may control the heater driving unit 332 to make the heater 510 to operate based on the amount of frost sensed at the frost sensing unit 500, or at every predetermined heating period. This will be described with reference to FIG. 4, later.

Figure 4:
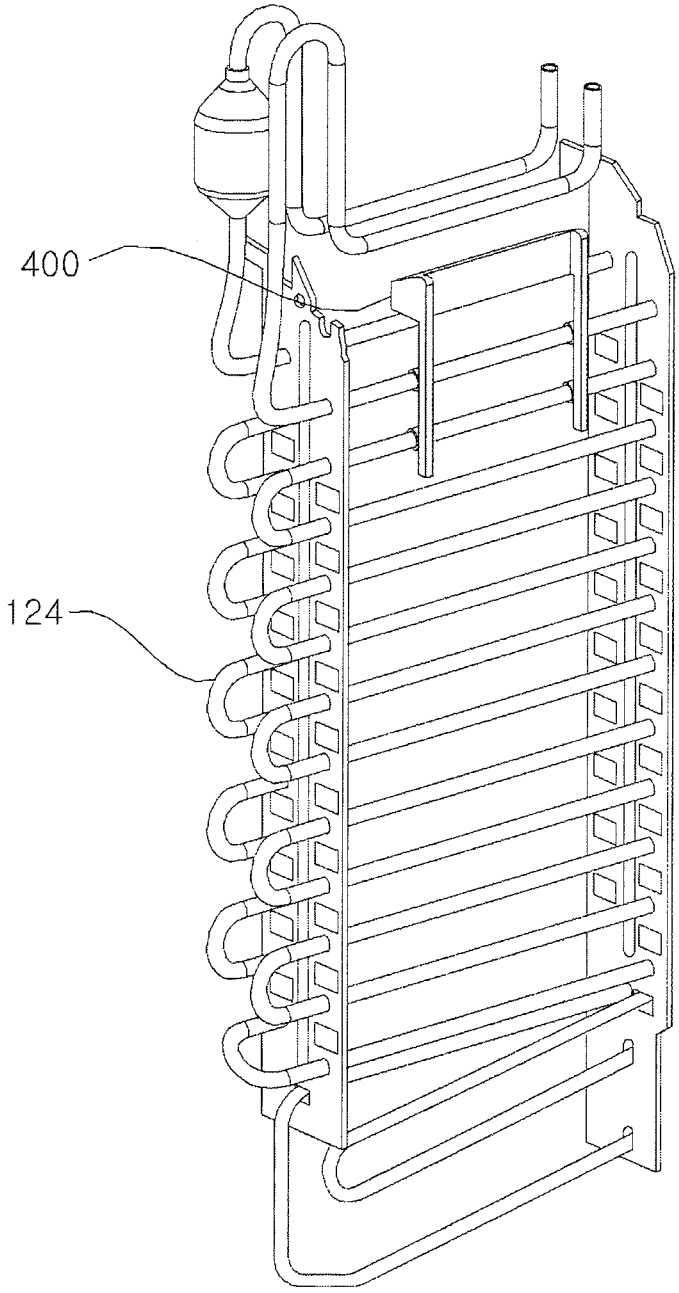
FIG. 4 is a perspective view illustrating an evaporator and a sensor mounter of a refrigerator in accordance with a preferred embodiment of the present invention.
Figure 5:
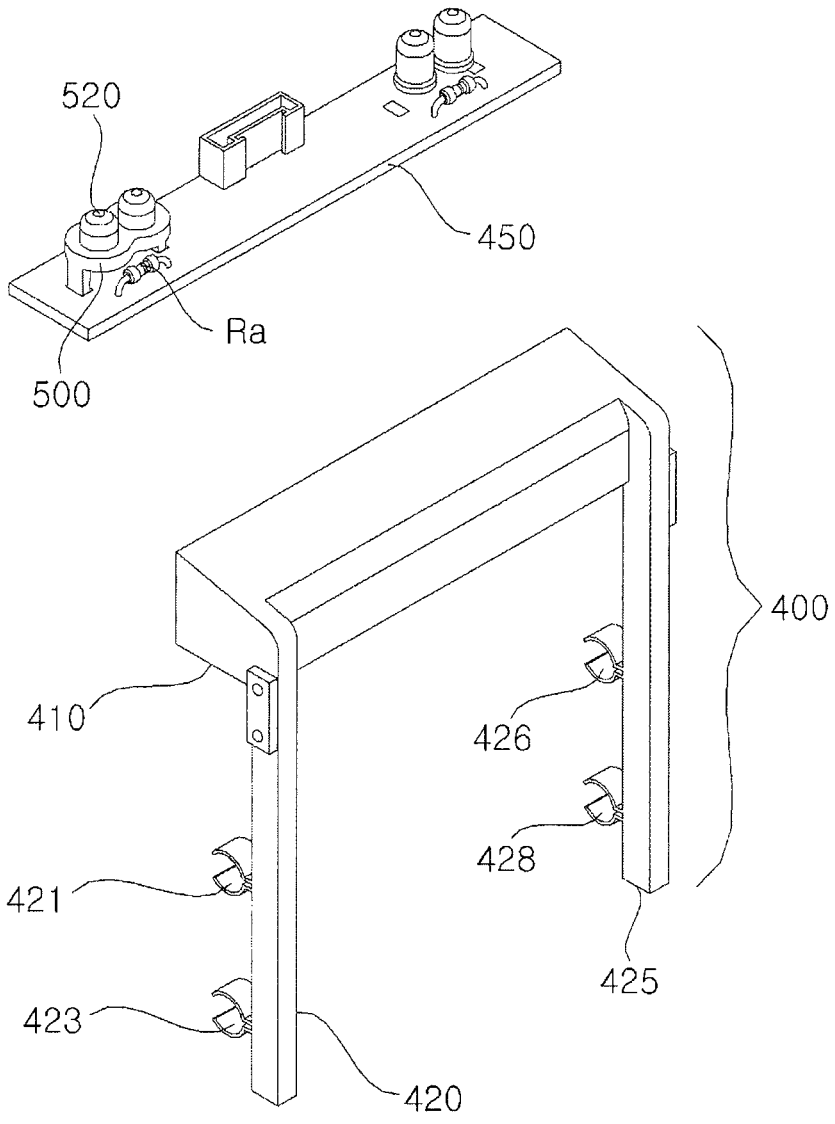
FIG. 5 is an exploded perspective view illustrating the frost sensing unit and the heater in FIG. 4.
Figure 6:
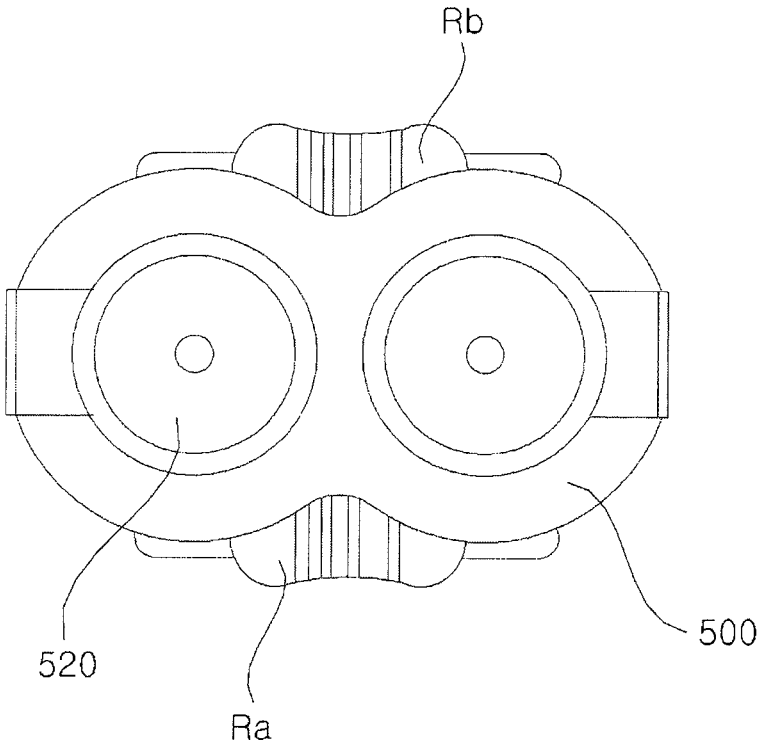
FIG. 6 is a schematic view illustrating an example of a light emitting unit and a heater in the frost sensing unit in FIG. 4.
Figure 7:
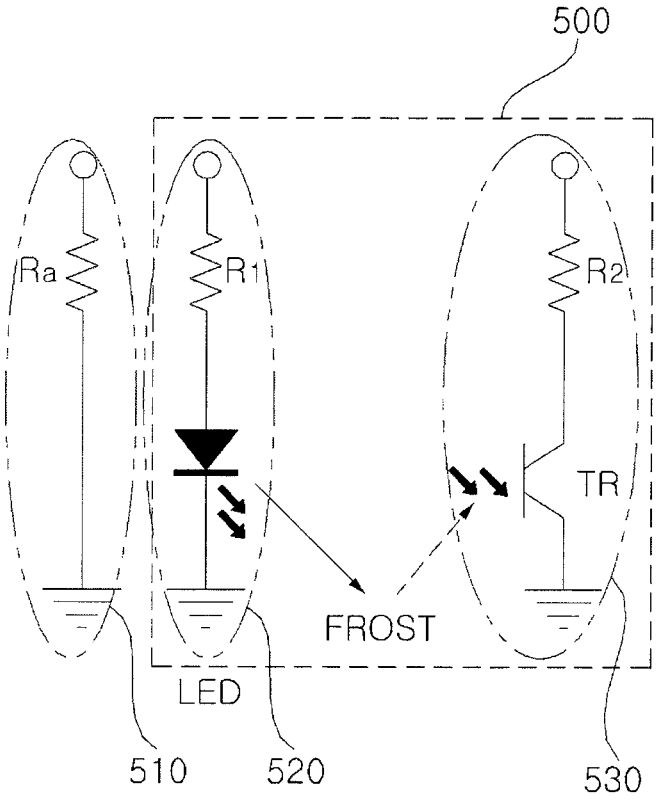
FIG. 7 is a schematic view illustrating a circuit diagram of the frost sensing unit and the heater in FIG. 4.

FIG. 4 is a perspective view illustrating an evaporator and a sensor mounter of a refrigerator in accordance with a preferred embodiment of the present invention, FIG. 5 is an exploded perspective view illustrating the frost sensing unit and the heater in FIG. 4, FIG. 6 is a schematic view illustrating an example of a light emitting unit and a heater in the frost sensing unit in FIG. 4, and FIG. 7 is a schematic view illustrating a circuit diagram of the frost sensing unit and the heater in FIG. 4.

Referring to FIGS. 4 to 7, as described with reference to FIG. 2, the evaporator 124 may be the freezing chamber evaporator. The sensor mounter 400 may be attached to the evaporator 124.

For this, the sensor mounter 400 may have a frame portion 410, and leg portions 420, and 425 extended in a vertical direction attached to the frame portion 410. And, each of the leg portions 420 and 425 may have piping connectors 421, 423, 426, and 428 arranged thereto for connection to a pipe of the evaporator 124.

In the meantime, the frame portion 410 may have an inserting space for enabling to insert a circuit board 450 therein, having the frost sensing unit 500 of a sensor type provided thereto. As shown, the circuit board 450 may be slidably inserted in, and secured to, the inserting space in the frame unit 410.

In the meantime, arranged on the circuit board 450, there may be the frost sensing unit 500 for sensing the amount of frost formed on the evaporator 124, and the heater 510, for an example, resistor device Ra, operated for removing the frost from the frost sensing unit 500.

The frost sensing unit 500 may have a light emitting unit 520 and a light receiving unit 53. The light emitting unit 520 can emit a light and the light receiving unit 530 receives the light and converts a light signal received thus to an electric signal. In this case, if there is the frost between the light emitting unit 520 and the light receiving unit 530, intensity or a size of the electric signal received at the light receiving unit 530 becomes smaller than a predetermined value, enabling to sense the frost, accordingly.

In the meantime, though the light emitting unit 520 may be an LED, various embodiments may be possible. In the meantime, though the light receiving unit 530 may be a photo-transistor 530, various embodiments may be possible.

In the meantime, if the frost is formed on the frost sensing unit 500, particularly, on the light receiving unit 530, the frost sensing unit 500 may sense as if the frost is formed, even if the frost is not formed on the evaporator, actually. In such a case, unnecessary defrosting operation may be carried out.

In order to prevent such a malfunction from taking place, the embodiment of the present invention suggests using the heater 510 arranged in the vicinity of the frost sensing unit 500 for removing the frost formed on the frost sensing unit 500, particularly, on the light receiving unit 530.

Though there may be various examples of the heater 510, FIG. 7 illustrates a heater having the resistor device Ra. In the meantime, in order to enhance a defrosting effect, the heater 510 may have a plurality of resistor devices provided thereto. FIG. 6 illustrates the resistor devices Ra and Rb arranged on both sides of the light emitting unit 520. In the meantime, though the light receiving unit 530 is arranged under the light emitting unit 520, the light receiving unit 530 is omitted from the drawing.

The control unit 310 controls the heater driving unit 332 to make a predetermined current Vcc to flow to the resistor device Ra, to operate the heater 510. According to this, heat is generated at the resistor device Ra enabling to remove the frost from a region adjacent thereto, particularly a surface of the light receiving unit 530, effectively.

In the meantime, operation timing of the heater 510 will be described in more detail.

Figure 8A:
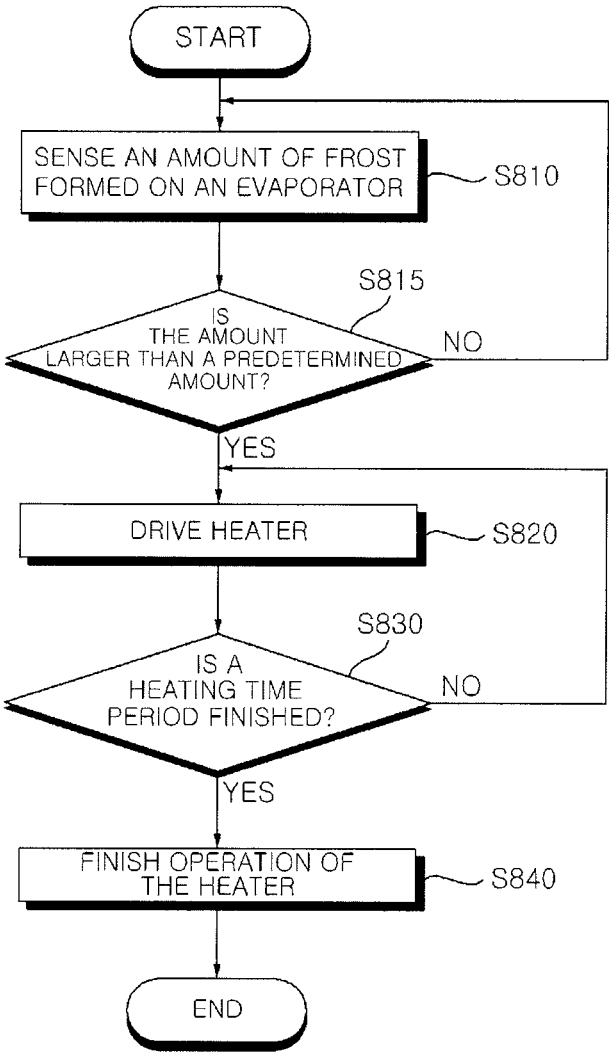
FIG. 8A is a flow chart illustrating the steps of a method for operating a refrigerator in accordance with a preferred embodiment of the present invention.
Figure 8B:
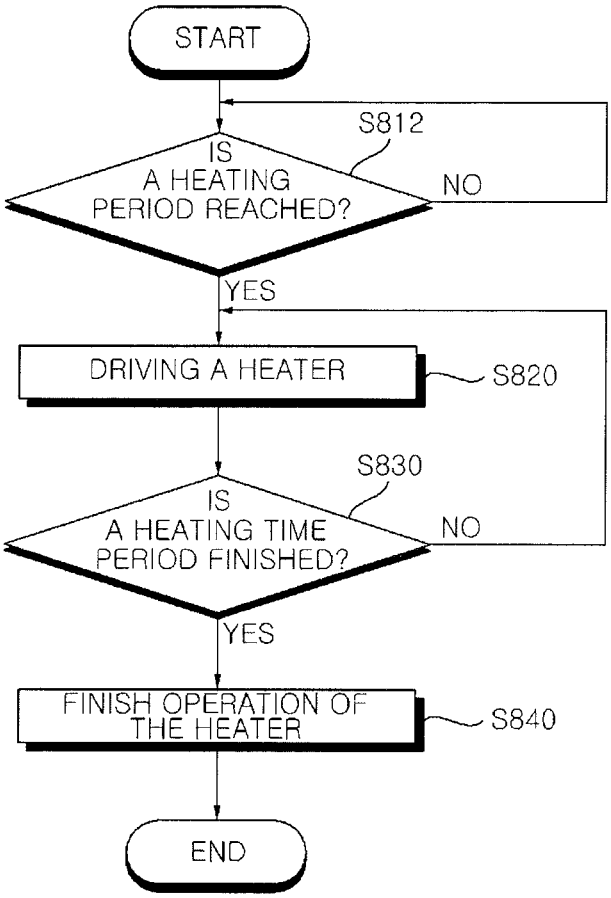
FIG. 8B is a flow chart illustrating the steps of a method for operating a refrigerator in accordance with another preferred embodiment of the present invention.

FIG. 8A is a flow chart illustrating the steps of a method for operating a refrigerator in accordance with a preferred embodiment of the present invention, FIG. 8B is a flow chart illustrating the steps of a method for operating a refrigerator in accordance with another preferred embodiment of the present invention, and FIGS. 9A to 9E are timing diagrams each illustrating frost removing sections of an evaporator according to the operating method of FIG. 8A or 8B.

Referring to FIGS. 8A to 9E, the frost sensing unit 500 of the refrigerator senses an amount of the frost formed on the evaporator 5810. The control unit 310 determines whether the amount of the frost sensed at the frost sensing unit 500 is larger than a predetermined value or not S815. And, if yes, the control unit 310 controls to drive the heater S820.

The light emitting unit 520 of the frost sensing unit 500 in the refrigerator is operated to emit the light. As illustrated in FIG. 7, the light emitting unit 520 may have the LED provided thereto. Upon application of an operation power Vcc to the light emitting unit 520, the power is applied to the LED passed through the resistor device R1. And, the LED emits the light according to the power applied thus. The light emitted thus may be a visible light or an infrared light.

In the meantime, if the light emits from the light emitting unit 520, the light receiving unit 530 is operated. That is, if the operation power Vcc is applied to the light receiving unit 530, the power is supplied to one end of the photo-transistor passed through the resistor device R2. If the frost is between the light emitting unit 520 and the light receiving unit 530, a light path is changed, making power applied to a base end of the photo-transistor lower than before, accordingly. And, the lower power makes a voltage between the base and an emitter higher than a predetermined voltage, making the photo-transistor of the light receiving unit 530 conductive, thereby sensing the frost.

Especially, since the larger the amount of the frost, the lower the voltage at the base end, to make a voltage difference between the base and the emitter the larger, making intensity of a current flowing through the photo-transistor the higher, at the end.

The frost sensing unit 500 of the refrigerator can sense the amount of the frost formed in the vicinity of the evaporator based on the intensity of the current flowing through the photo-transistor. That is, it may be determined that, the higher the intensity of the current flowing through the photo-transistor, the larger the amount of the frost formed.

The control unit 310 determines whether the amount of the frost sensed at the frost sensing unit 500 is larger than the predetermined value or not. That is, the control unit 310 can determine whether the intensity of the current flowing through the photo-transistor is higher than a predetermined value or not. If yes, the control unit 310 may control the defrosting heater 330 to operate for removing the frost from the evaporator 124 of the refrigerator. Along with this, the control unit 310 may control the heater 510 to operate.

In the meantime, after driving the heater, the control unit 310 determines whether a heating time period is finished or not S830. If the heating time period is finished, the control unit 310 turns off the heater S840.

Figure 9A:
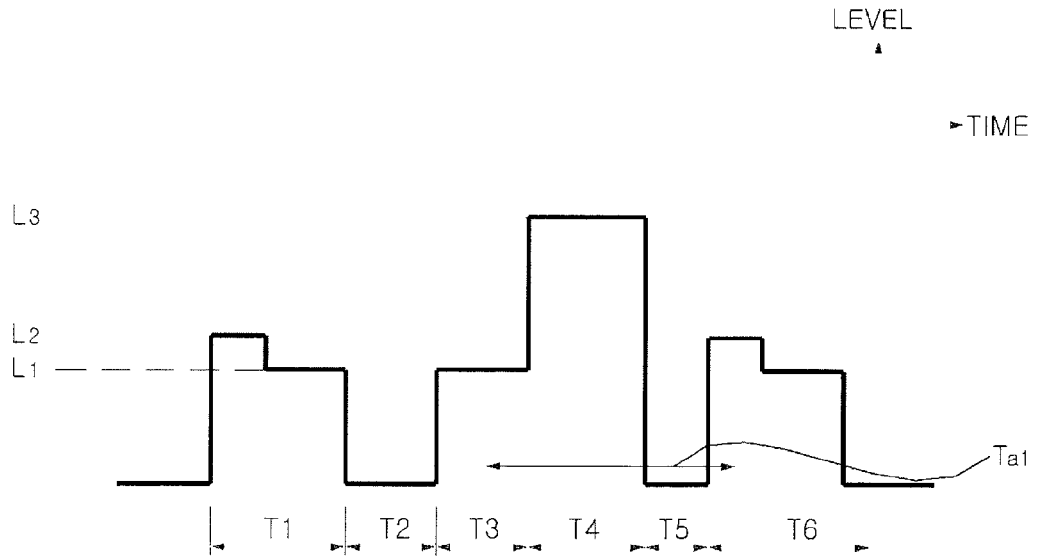
FIGS. 9A to 9E are timing diagrams each illustrating frost removing sections of an evaporator according to the operating method of FIG. 8A or 8B.
Figure 9B:
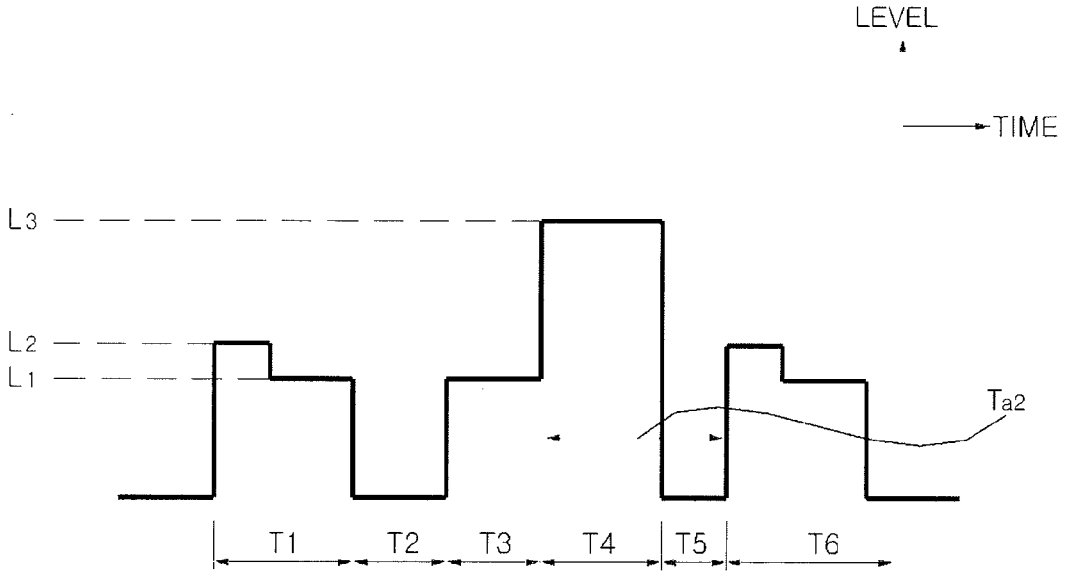

Defrosting operation will be described with reference to FIGS. 9A to 9E. FIGS. 9A to 9B illustrate timing diagrams each showing an operation section of the refrigerator and power consumption in the operation section.

A first section T1 is a cooling section in which the compressor 112 is turned on to be in operation, and the fan 144 is also turned on to be in operation. At an initial stage of the cooling section T1, though second power L2 is consumed for starting the compressor 112, first power L1 which is lower than the second power L2 may be consumed thereafter.

Then, a second section T2 is a pausing section in which the compressor 112 is turned off, and the fan 144 is also turned off. In the meantime, at an initial stage of the pausing section, though the compressor 112 is turned off, the fan 144 may be in operation, and thereafter the fan 144 may also be turned off.

Next, a third section T3 is a cooling section before defrosting in which the compressor 112 is turned on to be in operation, and the fan 144 is also turned on to be in operation. The section is an additional pre-cooling section before a defrosting section for preventing the temperature in the chamber of the refrigerator from rising due to increased power consumption in the defrosting section T4. In the cooling section before defrosting T3, first power L1 may be consumed.

In the meantime, though not shown in the drawing, it is possible to remove the refrigerant from the evaporator 124 between the third section T3 and the fourth section T4. If the refrigerant is remained in the evaporator 124 in the fourth section T4, i.e., the defrosting section, an operation time period of the defrosting heater 330 may be extended. In order to shorten the operation time period of the defrosting heater 330, the control unit 310 may control to remove the refrigerant from the evaporator 124. Such operation may be called a pump down.

Next, the fourth section T4 is the defrosting section. In the defrosting section, the defrosting heater 330 is operated. If heat exchange is performed at the evaporator 124 in the first section T1 and the third section T3, the frost may be formed in the vicinity of the evaporator 124.

The frost sensing unit 500 senses the amount of the frost formed on the evaporator 124, and the control unit 310 controls to carry out the defrosting operation if the amount of the frost sensed thus is larger than a reference value. That is, the control unit 310 controls the defrosting heater driving unit 331 to operate the defrosting heater 330. Since large power consumption is required for driving the defrosting heater 330, as shown in the drawing, a second power L3 may be consumed, which is the largest.

In the meantime, according to the embodiment of the present invention, if the amount of the frost sensed at the frost sensing unit 500 reaches to a predetermined value over the reference value, the heater 510 may be operated for preventing the frost from forming on the frost sensing unit 500.

Then, a fifth section T5 is a pause section after the defrosting. Accordingly, in the fifth section T5, the compressor 112 is turned off, and the fan 144 is also turned off. In the meantime, in an initial section of the pause section, though the compressor 112 may be turned off, the fan 144 may be in operation, and thereafter, the fan 144 may also be turned off.

Next, a sixth section T6 is a cooling section after the defrosting, in which the compressor 112 is turned on to be in operation, and the fan 144 is also turned on to be in operation. At an initial stage of the cooling section T6, though the second power L2 is consumed for starting the compressor 112, the first power L1 which is lower than the second power L2 may be consumed thereafter.

In the meantime, the heater 510 may be operated for at least a portion of the defrosting section. Particularly, FIGS. 9A to 9E illustrate different examples of the operation section of the heater 510.

FIG. 9A illustrates a first example of the operation section of the heater 510 in which the heater 510 may be operated in a first period Ta1, i.e., a portion of the cooling section T3 before defrosting, the defrosting section T4, the pausing section T5 after defrosting, and a portion of the cooling section T6 after defrosting.

The cooling section T3 before defrosting is provided for the defrosting section T4. The control unit 310 may control the heater 510 to operate in the cooling section T3 before defrosting in advance. That is, the heater 510 may be operated before the defrosting heater 330.

In the meantime, since the frost may also be formed on the frost sensing unit 500 in the pausing section T5 after defrosting, and in a portion of the cooling section T6 after defrosting, the heater 510 may be operated.

Next, FIG. 9B illustrates a second example of the operation section of the heater 510, in which the heater 510 may be operated in a second time period Ta2, i.e., the defrosting section T4, and the pausing section T5 after defrosting.

That is, while the heater 510 and the defrosting heater 330 are turned on at a time to be in operation, the defrosting heater 330 may be turned off at first, and, thereafter, the heater 510 may be turned off at the time of finishing the pausing section T5 after defrosting.

Figure 9C:
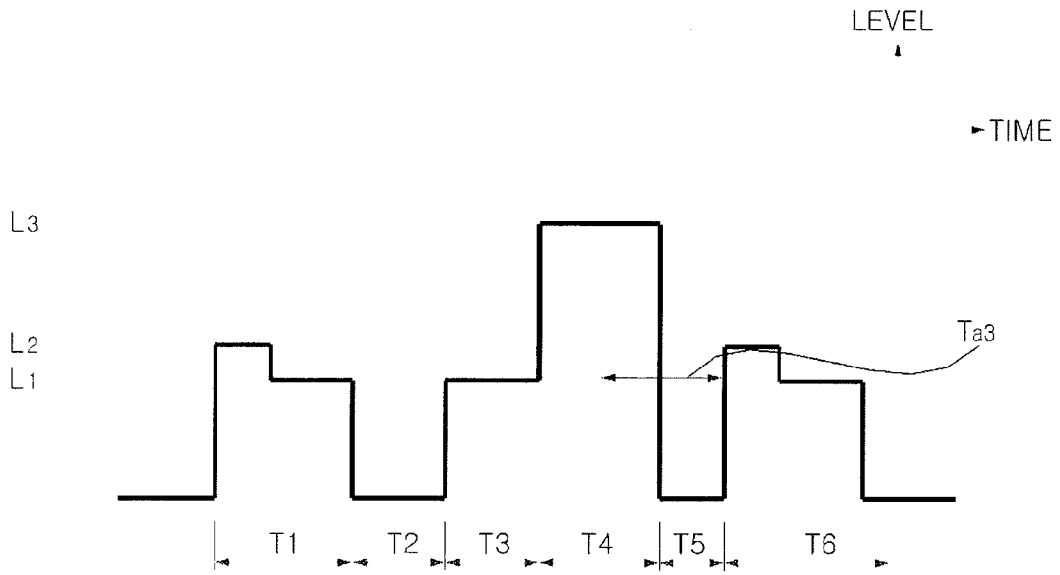

Next, FIG. 9C illustrates a third example of the operation section of the heater 510, in which the heater 510 may be operated in the third time period Ta3, i.e., a portion of the defrosting section T4, and the pausing section T5.

That is, while the heater 510 is operated after the defrosting heater 330 is turned on to be in operation, the defrosting heater 330 may be turned off at first, and, thereafter, the heater 510 may be turned off when the pausing section T5 after defrosting is finished.

Figure 9D:
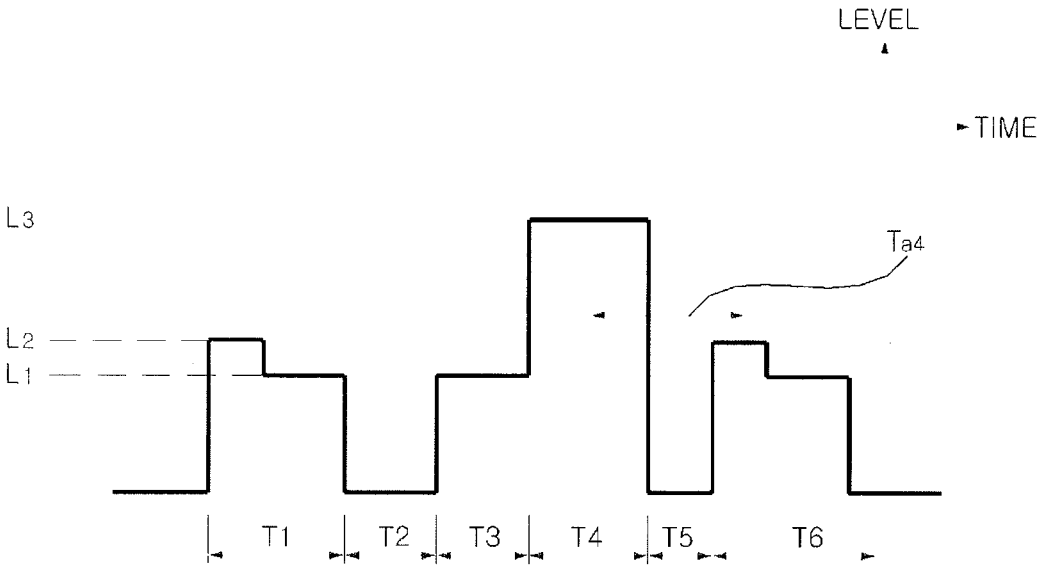

Next, FIG. 9D illustrates a fourth example of the operation section of the heater 510, in which the heater 510 may be operated in the fourth time period Ta4, i.e., a portion of the defrosting section T4, the pausing section T5 after defrosting, and a portion of the cooling section T6 after defrosting.

That is, while the heater 510 is in operation after the defrosting heater 330 is turned on to be in operation, the defrosting heater 330 is turned off at first, and, thereafter, the heater 510 may be turned off when the pausing section T5 after defrosting and a portion of the cooling section T6 after defrosting are finished.

Figure 9E:
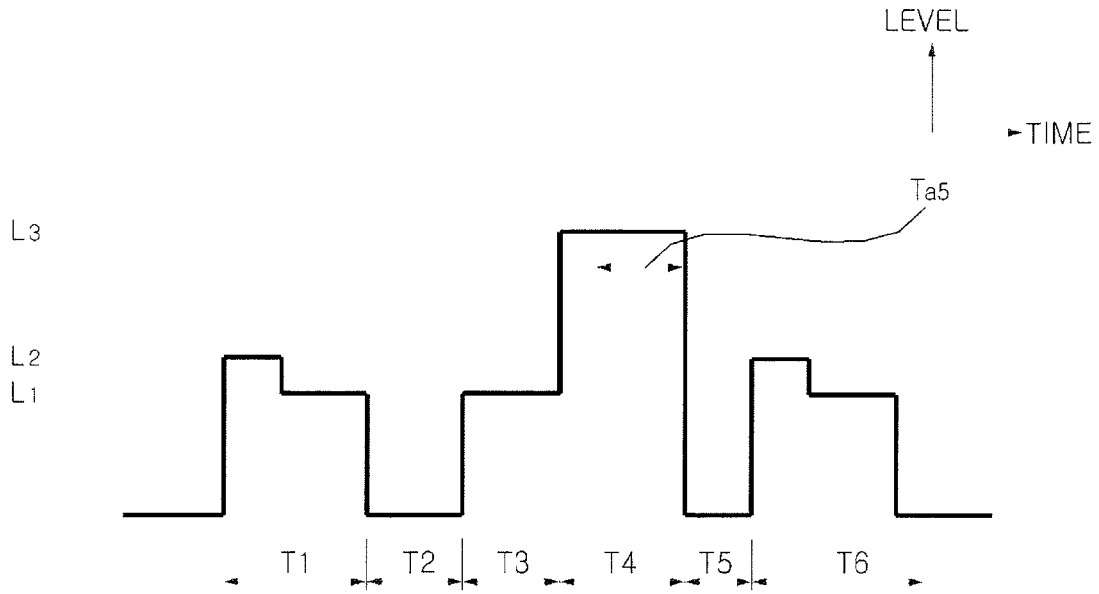

Next, FIG. 9E illustrates a fifth example of the operation section of the heater 510, in which the heater 510 may be operated only in the fourth time period Ta4, i.e., only a portion of the defrosting section T4.

That is, while the heater 510 is operated after the defrosting heater 330 is turned on to be in operation, the defrosting heater 330 and the heater 510 may be turned off at a time.

The first to fifth examples of the heater 510 operation described before may be classified according to the amount of frost sensed at the frost sensing unit 500. That is, the larger the amount of the frost, the longer the operation time period of the heater 510.

Particularly, the heater 510 may have a heating period varied with the amount of frost sensed at the frost sensing unit 500. For an example, the larger the amount of frost sensed at the frost sensing unit 500, the shorter the heating period of the heater 510.

In detail, the first to fifth examples of the operation time periods of the heater 510 respectively illustrate operable time periods of the heater 510. In the operation time period, the heater 510 may also be turned on/off periodically. In such a case, the heater 510 may have the heating period varied with the amount of frost sensed at the frost sensing unit 500.

For an example, like the fifth example, if the heater 510 is operated in a portion of the defrosting section T4, the heater 510 may be turned on/off in the operation time period T5 periodically. In this case, if the amount of frost sensed at the frost sensing unit 500 is large, the heating period will be shortened, to increase a heating timing.

Then, referring to FIG. 8B, according to setting done already, the control unit 310 determines whether the heating period is reached or not S812. And, if yes, the control unit 310 controls to drive the heater S820.

The memory 240 may have the heating period of the heater 510 stored therein for removing the frost from the frost sensing unit 500.

In such a case, the control unit 310 may determine whether the heater 510 is put into operation or not by using the heating period stored in the memory 240. And, if the heating period is reached, the control unit 310 may control the heater 510 to operate. According to this, regular and periodic frost removal from the frost sensing unit 500 may be possible.

In the meantime, after the heater is put into operation thus, the control unit 310 determines whether the heating time period is finished or not S830. If the heating time period is finished, the control unit 310 finishes the operation of the heater S840.

In the meantime, upon comparison of the operation of the frost sensing unit 500 to the operation of the heater 510, the following operation may be possible.

If the frost sensing unit 500 is turned on to be in operation, and the heater 510 is turned on to be in operation, the frost sensing unit 500 is turned off not to be in operation, and if the heater 510 is turned on to be in operation, the frost sensing unit 500 is turned on to be in operation, and the heater 510 is turned off not to be in operation.

The refrigerator and the method for operating the same according to the present invention are not intended to be limited to the above-described embodiment and drawings, and all or a portion of the embodiments may be combined selectively to be able to make various changes.

In the meantime, it is possible that the method for operating a refrigerator in accordance with an embodiment of the present invention may be embodied in codes which are readable by a process at a recording medium which a processor provided to the refrigerator is readable. The recording medium the processor is readable includes all kinds of recording devices in which a data thereon readable by the processor may be stored therein. As an example of the recording medium readable by the processor, there are ROM, RAM, CD-ROM, magnetic tape, floppy disc, optical data storage device, and so on, inclusive of ones embodied in a mode of carrier wave, such as transmission through the Internet. And, the recording medium readable by the processor may have codes which can be stored therein and run, and can be distributed to a computer system connected with networks and readable by the processor with a distribution system.

As has been described, the refrigerator and the method for operating the same of the present invention have the following advantages.

The refrigerator can remove the frost from the frost sensing unit regularly as the refrigerator includes an evaporator to carry out heat exchange, a frost sensing unit to sense an amount of frost formed on the frost sensing unit, and a heater to be operated for removing the frost from the frost sensing unit, to operate the heater in at least a portion of a defrosting section.

Particularly, the refrigerator can prevent water vapor formed during removing the frost from the evaporator of the refrigerator and attached to the frost sensing unit from interfering with sensing of the frost sensing unit.

In the meantime, the heater provided for removing the frost from the frost sensing unit of the refrigerator may be operated in at least a portion of a cooling section before the defrosting section, the defrosting section, a pausing section, and at least a portion of a cooling section after the defrosting section, thereby permitting to remove the frost from the frost sensing unit, regularly.

In the meantime, the heater provided for removing the frost from the frost sensing unit of the refrigerator may be operated in at least a portion of the defrosting section, and a pausing section after the defrosting section, thereby permitting to remove the frost from the frost sensing unit, regularly.

In the meantime, the heater provided for removing the frost from the frost sensing unit of the refrigerator may be operated in at least a portion of the defrosting section, the pausing section after the defrosting section, and at least a portion of the cooling section after the defrosting section, thereby permitting to remove the frost from the frost sensing unit, regularly.

In the meantime, the heater provided for removing the frost from the frost sensing unit of the refrigerator may be operated by varying a heating period or a heating time period with the amount of the frost formed on the evaporator, thereby permitting to remove the frost from the frost sensing unit, regularly.

And, though preferred embodiments of the present invention have been shown in the drawings and described, the present invention is not limited to above described specific embodiments, but it is apparent that various changes may be possible by a person skilled in this field of art without departing from scope sprit of the present invention, and the various changes are required to be understood not separate from technical aspects of the present invention.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A refrigerator comprising:

an evaporator configured to perform heat exchange with air in the refrigerator;

a first heater configured to defrost the evaporator;

a frost sensing unit configured to sense an amount of frost formed on the frost sensing unit;

a second heater configured to remove the frost from the frost sensing unit; and a controller configured to:

operate the first heater during a defrosting period to defrost the evaporator; and operate the second heater during at least a portion of the defrosting period to defrost the frost sensing unit, wherein the refrigerator includes a compressor, wherein the controller is configured to provide a cooling period when the compressor is on prior to the defrosting period, a pausing period when the compressor is off after the defrosting period, and a cooling period when the compressor is on after the defrosting period, wherein the controller is configured to control the second heater to be operated at least during at least the portion of the defrosting period and during the pausing period, and wherein the controller is configured to remove refrigerant from the evaporator during the defrosting period.

2. The refrigerator as claimed in claim 1, wherein the controller is configured to control the second heater to be operated when the amount of the frost formed on the frost sensor is larger than a predetermined value.

3. The refrigerator as claimed in claim 2, wherein a heating period of the second heater varies based on the amount of the frost formed on the frost sensing unit.

4. The refrigerator as claimed in claim 1, wherein the controller is configured to control the second heater to be operated for a predetermined heating period.

5. The refrigerator as claimed in claim 1, wherein the controller is configured to control the second heater to be operated during at least a portion of the cooling period prior to the defrosting period, during the defrosting period, during the pausing period, and during at least a portion of the cooling period after the defrosting period.

6. The refrigerator as claimed in claim 1, wherein the controller is configured to control the second heater to be operated during at least the portion of the defrosting period, during the pausing period, and during at least a portion of the cooling period after the defrosting period.

7. The refrigerator as claimed in claim 1, wherein the frost sensing unit includes:

a light emitting unit to emit a light; and a light receiving unit to receive the light emitted by the light emitting unit, and wherein the second heater is configured to remove the frost from the light receiving unit.

8. The refrigerator as claimed in claim 1, wherein the second heater includes a resistor device configured to generate heat to remove the frost from the frost sensing unit.

9. The refrigerator as claimed in claim 1, wherein the controller is configured to operate the refrigerator to remove refrigerant from the evaporator before the defrosting period occurs.

10. A method of operating a refrigerator including a compressor, the method comprising:

sensing, via a frost sensing unit, an amount of frost formed on an evaporator during an operation period of the refrigerator, the operation period including a cooling period when the compressor is on prior to a defrosting period for defrosting the evaporator by a first heater, a pausing period when the compressor is off after the defrosting period, and a cooling period when the compressor is on after the defrosting period;

operating a second heater when the amount of frost formed is larger than a predetermined value to remove frost from the frost sensing unit; and stopping operation of the second heater when a heating time period of the second heater is finished, wherein the second heater is operated during at least a portion of the defrosting period when the first heater is being operated, wherein operating the second heater includes operating the second heater at least during at least the portion of the defrosting period and during the pausing period, and wherein the method further comprises removing refrigerant from the evaporator during the defrosting period.

11. The method as claimed in claim 10, wherein operating the second heater includes operating the second heater during at least a portion of the cooling period prior to the defrosting period, during the defrosting period, during the pausing period, and during at least a portion of the cooling period.

12. The method as claimed in claim 10, wherein operating the second heater includes operating the second heater during at least the portion of the defrosting period, during the pausing period, and during at least a portion of the cooling period after the defrosting period.

13. The method as claimed in claim 10, wherein the heating period of the second heater varies based on the amount of the frost formed on the frost sensing unit.

14. A method of operating a refrigerator including a compressor, the method comprising:

controlling operation of the refrigerator by a controller during an operation period, the operation period including a cooling period when the compressor is on prior to a defrosting period to defrost an evaporator using a first heater, a pausing period when the compressor is off after the defrosting period, and a cooling period when the compressor is on after the defrosting period;

operating a second heater when a heating period of the second heater is reached during the operation period to remove frost from a frost sensing unit; and stopping operation of the second heater when a heating time period of the second heater is finished, wherein the second heater is operated at least during at least a portion of the defrosting period when the first heater is being operated and during the pausing period, and wherein the method further comprising removing refrigerant from the evaporator during the defrosting period.

15. The method as claimed in claim 14, wherein operating the second heater includes operating the second heater during at least a portion of the cooling period prior to the defrosting period, during the defrosting period, during the pausing period, and during at least a portion of the cooling period after the defrosting period.

* * * * *